US005690518A

United States Patent [19]

Roy et al.

[11] Patent Number: 5,690,518

[45] Date of Patent: Nov. 25, 1997

[54] FEMALE AND MALE ELECTRICAL CONNECTORS REQUIRING LOW INSERTION FORCES

[75] Inventors: Dhirendra C. Roy, Canton; Zenon Hotra, Troy, both of Mich.; Steven K. Heckman, Fort Wayne, Ind.

[73] Assignee: United Technologies Automotive, Inc., Dearborn, Mich.

[21] Appl. No.: 610,801

[22] Filed: Mar. 7, 1996

Related U.S. Application Data

[63] Continuation of Ser. No. 166,214, Dec. 13, 1993, abandoned.

[51] Int. Cl.[6] ..... H01R 13/05; H01R 13/62

[52] U.S. Cl. ..... 439/851; 439/825

[58] Field of Search ..... 439/825, 842, 439/851, 856

[56] References Cited

U.S. PATENT DOCUMENTS

| | | | |
|---|---|---|---|
| 3,894,785 | 7/1975 | Habner | 439/825 |
| 3,917,377 | 11/1975 | Hall et al. . | |
| 3,947,959 | 4/1976 | DuRocher . | |
| 4,212,509 | 7/1980 | Brooks et al. . | |
| 4,550,972 | 11/1985 | Romak | 439/851 |
| 4,666,227 | 5/1987 | Galizia | 439/851 |
| 4,707,050 | 11/1987 | Konnemann | 439/851 |
| 4,717,359 | 1/1988 | Rahrig et al. . | |
| 4,792,307 | 12/1988 | Stewart, Sr. . | |
| 4,988,316 | 1/1991 | Roy . | |
| 5,004,438 | 4/1991 | Cabourne | 439/825 |
| 5,032,090 | 7/1991 | Roy . | |
| 5,106,329 | 4/1992 | Maeshima | 439/851 |
| 5,131,873 | 7/1992 | Gierut | 439/851 |
| 5,135,418 | 8/1992 | Hatagishi | 439/851 |
| 5,209,680 | 5/1993 | Fry | 439/825 |
| 5,308,267 | 5/1994 | Hotea | 439/851 |
| 5,360,356 | 11/1994 | May | 439/851 |

FOREIGN PATENT DOCUMENTS

| | | |
|---|---|---|
| 1539393 | 9/1968 | France . |
| 2 378 377 | 8/1978 | France . |
| 1 565 973 | 3/1970 | Germany . |
| 2050758 | 5/1971 | Germany . |
| 8330470 | 4/1985 | Germany . |
| 8804092 | 6/1988 | Germany . |
| 1319059 | 5/1973 | United Kingdom . |

*Primary Examiner*—Kurt Rowan

*Attorney, Agent, or Firm*—Harness, Dickey & Pierce, P.L.C.

[57] ABSTRACT

A female electrical connector has a wire attachment segment and a receptacle segment. A pair of apertures are juxtapositioned within the receptacle segment circumferentially separated from one another by solid portions of the receptacle segment therebetween. A male electrical connector has a wire attachment segment, a bulged segment and a shaft segment. The male electrical connector has a longitudinal channel positioned within the shaft segment. Considered individually or together, these electrical connectors substantially reduce required insertion forces.

21 Claims, 3 Drawing Sheets

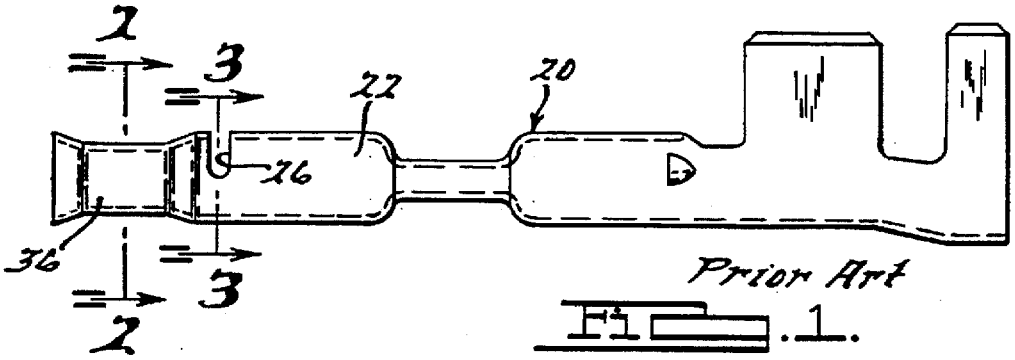
Prior Art
FIG. 1.
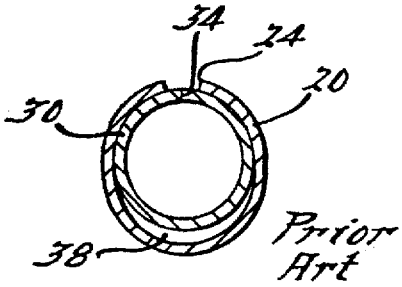
Prior Art
FIG. 2.
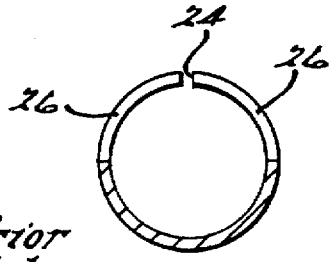
Prior Art
FIG. 3.
FIG. 5.
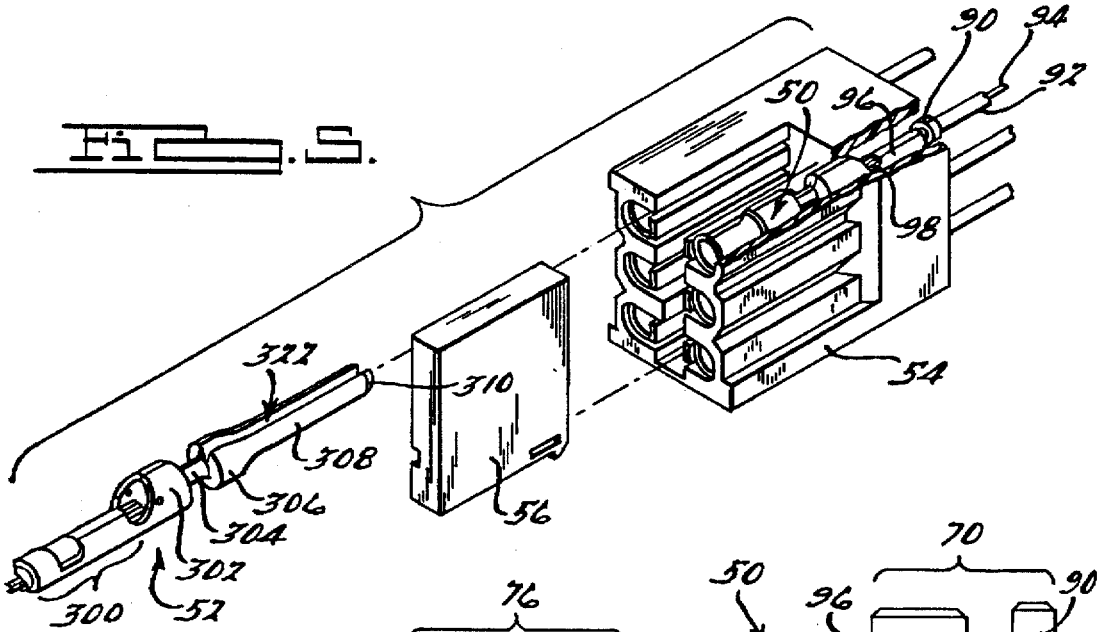
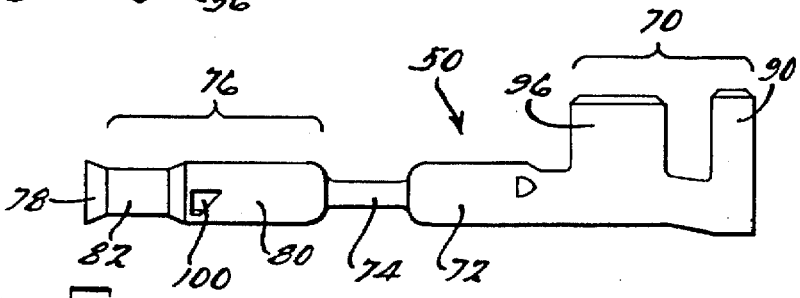
FIG. 6.

FEMALE AND MALE ELECTRICAL CONNECTORS REQUIRING LOW INSERTION FORCES

This is a continuation of U.S. patent application Ser. No. 08/166,214, filed Dec. 13, 1993, now abandoned.

BACKGROUND OF THE INVENTION

The invention relates generally to an electrical connection and specifically to an electrical connection employing mating female and male electrical connectors.

In automotive vehicles, it is common to have many electrical connections between electrically conductive wires. These wires typically supply direct current from a battery to a variety of electrical components including, for example, switches, electrical motors and lamps. Most electrical connections are achieved through coupling mating female and male electrical connectors. Furthermore, it is common to bundle like sets of female or male electrical connectors together in a connector block. This promotes ease of assembly when the connection is made.

One such traditional female electrical connector is shown in FIGS. 1 through 3. The female electrical connector 20 has a hollow cylindrical section 22 with a longitudinal seam 24. A pair of symmetrically opposing slots 26 circumferentially extend around the cylindrical section beginning at the seam. A traditional male electrical connector 30 is shown in FIGS. 2 and 4. The male electrical connector has a cylindrical shaft 32 with a longitudinal seam 34. The shaft is inserted within the conventional female electrical connector so as to electrically engage a collar section 36. However, due to the circumferentially expansive slots within the female electrical connector, the circumferentially remaining portion of the cylindrical section must substantially flex to account for any misalignment between connectors. Unfortunately, the prior art allows misalignment creating a gap 38 between the male electrical connector and the female electrical connector as shown in FIG. 2. This misalignment of parts can create an undesirable stress distribution within the female electrical connector and reduces the effective contact between the connectors. Consequently, electrical resistance is increased and the resulting additional heat build-up would make the connector system less reliable.

The conventional male electrical connector may further create an undesirable set to the female electrical connector if the shaft is at its maximum circumferential tolerance. Additionally, if the female electrical connector is at a minimum circumferential tolerance then this undesirable set is exacerbated. Not only does this situation require undesirably high insertion forces between connectors but it also causes reduced contact area leading to a less effective electrical coupling. Therefore, it would be desirable to provide an improved female electrical connector and an improved male electrical connector which together or individually provide for low insertion forces, lower electrical resistance, and improved electrical performance so as to avoid the aforementioned problems with conventional connectors or systems.

SUMMARY OF THE INVENTION

In accordance with the present invention, the preferred embodiment of a new and useful female electrical connector and a new and useful male electrical connector provide low insertion forces, low electrical contact resistance and improved electrical performance whether used individually or together. The female electrical connector has a wire attachment segment and a receptacle segment. A pair of apertures are juxtapositioned within the receptacle segment, however, the apertures are circumferentially separated from one another by solid portions of the receptacle segment therebetween. The male electrical connector has a wire attachment segment, a bulged segment and a shaft segment. The shaft segment has a longitudinal channel depressed therein which allows for higher radial deflection of the shaft segment during installation within a female electrical connector. The present invention also provides for the combination of the present invention female electrical connector and the present invention male electrical connector.

The female electrical connector of the present invention provides for a higher degree of evenly dispersed cross sectional material circumferentially adjacent to the pair of apertures therein. This allows for a lower spring rate of the female connector due to the remaining material adjacent to the apertures thereby leading to lower and more controllable insertion forces. The remaining solid portions of the receptacle segment also eliminate misalignment and significantly reduce an air gap between misaligned female and male electrical connectors. Furthermore, this also reduces heat generated by the traditionally occurring localized electrical resistance and thus reduces the overall connector temperature build-up. Consequently, the present invention provides for a higher stress relaxation time, since the remaining solid portions of the receptacle segment are more efficiently disposed in relation to a mating male electrical connector.

The male electrical connector of the present invention is advantageous over conventional designs since the longitudinal channel allows for a higher degree of radial deflection, therefore, reduced insertion forces are required during installation into a female electrical connector. This prevents any undesirable over expansion or setting of the female electrical connector. Furthermore, the radially inward angle of a pair of longitudinal edges adjacent to a seam of the shaft within the longitudinal channel prevents undesired disfiguration, marring or scratching of the plating on a female electrical connector. This longitudinal channel within the present invention male electrical connector also provides for improved longitudinal rigidity of the shaft.

Of course, the female electrical connector and the male electrical connector of the present invention can be used together or can be used independently. Additional advantages and features of the present invention will become apparent from the following description and appended claims, taken in conjunction with the accompanying drawings.

BRIEF DESCRIPTION OF THE DRAWINGS

FIG. 1 is a side elevational view of a prior art female electrical connector;

FIG. 2 is a cross sectional view, taken along line 2—2 of FIG. 1, of a prior art male electrical connector inserted within the prior art female electrical connector;

FIG. 3 is a cross sectional view, taken along line 3—3 of FIG. 1, of the prior art female electrical connector;

FIG. 5 is an exploded perspective view, with portions broken away therefrom, of a male electrical connector of the present invention and a female electrical connector of the present invention;

FIG. 6 is a side elevational view of a first preferred embodiment of the female electrical connector of the present invention of FIG. 5;

DETAILED DESCRIPTION OF THE PREFERRED EMBODIMENTS

Figure 4:
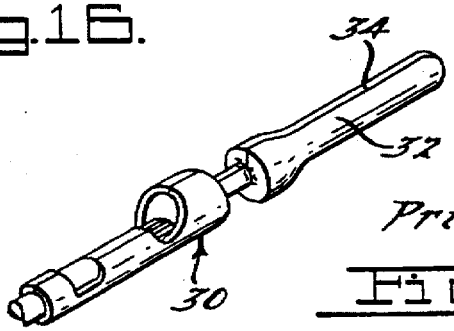
Prior Art Fig. 4.
FIG. 4 is a perspective view of the prior art male electrical connector of FIG. 2.

Referring to FIG. 5, the present invention is comprised of a female electrical connector 50 and a male electrical connector 52 which can be mated to each other. A plurality of female electrical connectors 50 are shown bundled together within a polymeric connector block 54 and locked in place by use of a central polymeric locking plate 56. A plurality of male electrical connectors 52 can be similarly bundled together. Of course, female electrical connector 50 can be used in combination with the present invention male electrical connector 52 or may alternately be used in combination with a variety of conventional male electrical connectors such as male electrical connector 30 (see FIG. 4) depending on the specific application and requirements. Moreover, male electrical connector 52 can also be used in combination with female electrical connector 50 of the present invention or with traditional female electrical connectors such as female electrical connector 20 (see FIG. 1).

Figure 7:
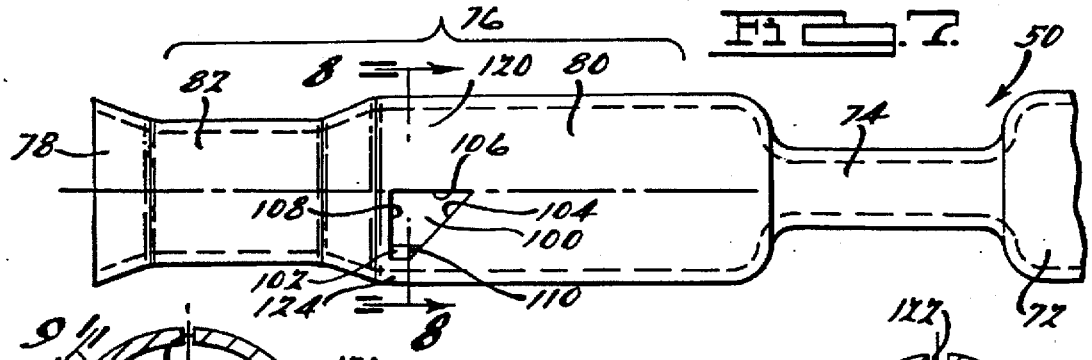
FIG. 7 is an enlarged fragmentary side elevational view of the first preferred embodiment of the female electrical connector of the present invention of FIG. 6.
Figure 8:
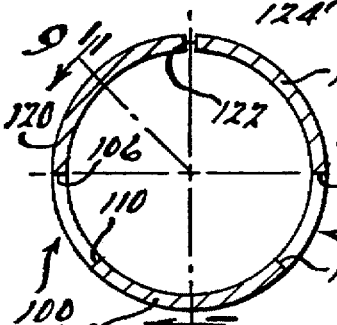
FIG. 8 is a cross sectional view, taken along line 8—8 of FIG. 7, of the first preferred embodiment of the female electrical connector of the present invention.

The first preferred embodiment of female electrical connector 50 is shown in FIGS. 6 through 8. Female electrical connector 50 is comprised of a wire attachment segment 70, a base segment 72, a neck segment 74, a receptacle segment 76 and a lead-in or frusto-conical segment 78. Receptacle segment 76 is further comprised of a barrel section 80 and a collar section 82. Base segment 72, neck segment 74, barrel section 80 and collar section 82 are all substantially cylindrical in shape, coaxial about a longitudinal axes therethrough and are hollow throughout. As is illustrated in FIGS. 5 and 6, wire attachment segment 70 is comprised of a first pair of foldable arms 90 which are securely crimped about an electrically insulated covering 92 surrounding an electrically conductive wire 94. Wire attachment segment 70 further has a second pair of arms 96 which are securely crimped onto a distal end 98 of wire 94. Female electrical connector 50 can be tin plated. Apertures and the outer periphery features are cut within a series of punches from a single sheet of copper based material and the form is shaped by a set of progressive stamping dies. Accordingly, wire attachment segment 70, base segment 72, neck segment 74, receptacle segment 76 and frusto-conical segment 78 are all electrically coupled to one another in a conductive manner.

Referring again to FIGS. 7 and 8, a pair of longitudinally opposing apertures 100 are located within barrel section 80. Each aperture 100 is defined by a trapezoidal inner edge 102 comprised of four straight edge sections 104, 106, 108 and 110. Each edge section 106 is circumferentially bordered by a remaining solid portion 120 of barrel section 80 which extends around to a longitudinal seam 122. Similarly, a remaining solid portion 124 circumferentially extends between each edge section 110.

A second preferred embodiment of female electrical connector 50 has a pair of longitudinally opposed apertures 150 disposed within collar section 152 which is longitudinally longer than that of the first embodiment. Each aperture 150 is defined by an inner edge 154 constructed from four straight edge sections 156, 158, 160 and 162. Edge sections 156 and 162 are joined by a rounded corner section 164.

A third preferred embodiment of female electrical connector 50 has a pair of octagonal apertures 180 longitudinally opposing one another within an elongated collar section 182. Each aperture 180 is defined by an inner edge 184 comprised of a pair of longitudinally oriented elongated straight edge sections 186 and 188, a pair of laterally oriented shortened straight edge sections 190 and 192, and four straight corner edge sections 194, 196, 198 and 200.

Figure 13:
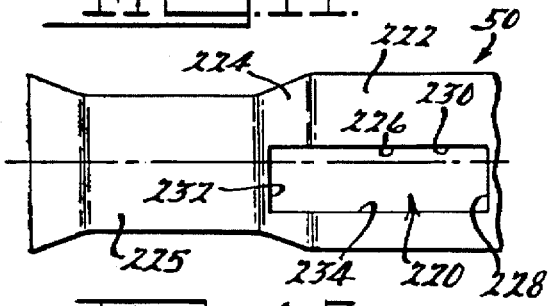
FIG. 13 is an enlarged fragmentary side elevational view of a fourth preferred embodiment of the female electrical connector of the present invention of FIG. 5.

FIG. 13 illustrates a fourth preferred embodiment of the present invention female electrical connector 50. This female electrical connector 50 has a pair of longitudinally opposing apertures 220 juxtapositioned within both a barrel section 222 and an adjacent angled intermediate section 224. Intermediate section 224 bridges between barrel section 222 and a collar section 225. Each aperture 220 is defined by a longitudinally elongated substantially rectangular inner edge 226. Each inner edge 226 is comprised of four perpendicularly disposed substantially straight edge sections 228, 230, 232 and 234.

Figure 14:
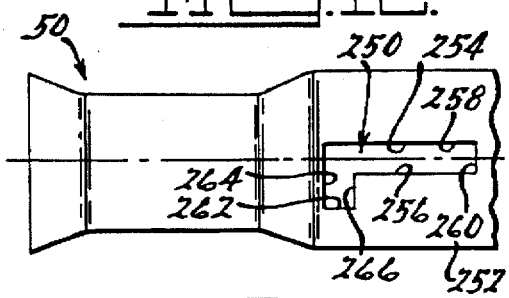
FIG. 14 is an enlarged fragmentary side elevational view of a fifth preferred embodiment of the female electrical connector of the present invention of FIG. 5.

A fifth preferred embodiment of the female electrical connector 50 of the present invention is shown in FIG. 14. A pair of longitudinally opposing apertures 250 are located within a barrel section 252 and are each defined by an L-shaped inner edge 254. Inner edge 254 is comprised of a pair of longitudinally oriented elongated straight edge sections 256 and 258. Inner edge 254 is also comprised of a cap edge section 260 and a foot edge section 262 which joins transversely oriented edge sections 264 and 266.

Referring to FIGS. 5 and 15 through 17, the preferred embodiment of male electrical connector 52 is comprised of a wire attachment segment 300, a pedestal segment 302, a constricted segment 304, a bulged segment 306, a shaft segment 308 and a head segment 310. Wire attachment segment 300, pedestal segment 302 and constricted segment 304 are constructed substantially similar to the previously described wire attachment segment 70, base segment 72 and neck segment 74 (see FIG. 6) of female electrical connector 50. Male electrical connector 52 can be stamped from a tin plated electrically conductive metallic material such as a cartridge brass material which is approximately 70% copper and 30% zinc.

Figure 10:
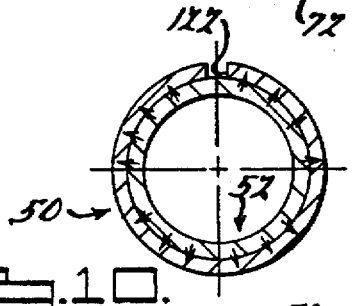
FIG. 10 is a cross sectional view, taken along line 10—10 of FIG. 9, of the first preferred embodiment of the female electrical connector of the present invention and the preferred embodiment of the male electrical connector of the present invention.
Figure 9:
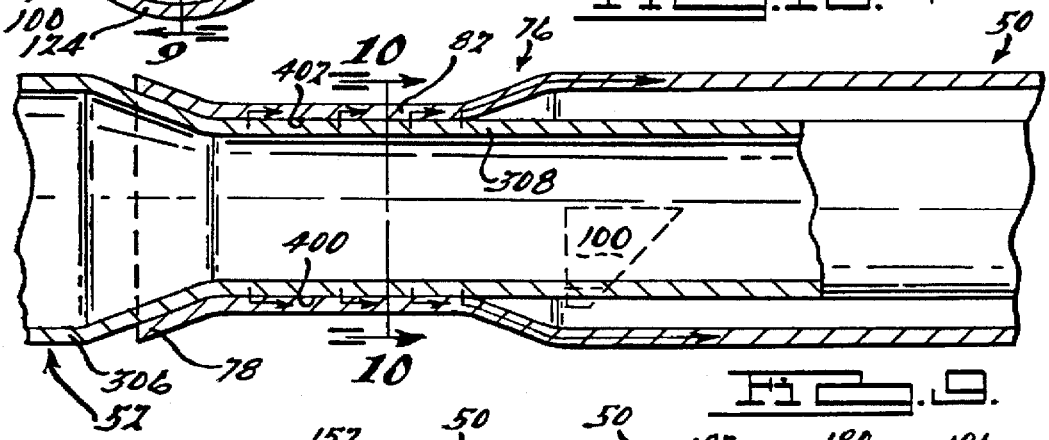
FIG. 9 is a sectional view, taken along line 9—9 of FIG. 8, of the first preferred embodiment of the female electrical connector of the present invention and the preferred embodiment of the male electrical connector of the present invention of FIG. 5.
Figure 11:
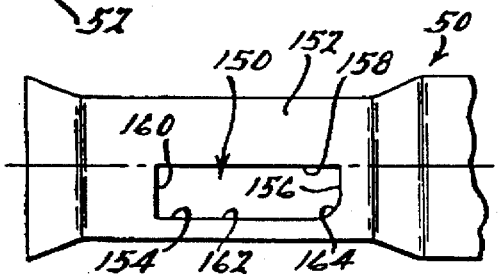
FIG. 11 is an enlarged fragmentary side elevational view of a second preferred embodiment of the female electrical connector of the present invention of FIG. 5.
Figure 12:
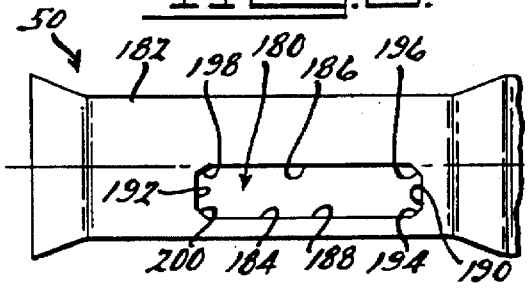
FIG. 12 is an enlarged fragmentary side elevational view of a third preferred embodiment of the female electrical connector of the present invention of FIG. 5.

Shaft segment 308 has a cylindrically-shaped wall 320 with a hollow core oriented in a longitudinal direction. A longitudinal channel 322 extends from head segment 310 through shaft segment 308 and through bulged segment 306. Channel 322 is comprised of a pair of radially extending walls 324 and 326 which intersect at a trough 328 proximate with a seam 330. Accordingly, a peripheral edge 332 of each wall 324 and 326 is inwardly turned toward the center axis of male electrical connector 52. Shaft segment 308 of male electrical connector 52 is insertably matable within receptacle segment 76 of female electrical connector 50. This is shown in FIGS. 9 and 10. Accordingly, an exterior surface 400 of shaft segment 308 is in electrically conductive contact with interior surface 402 of collar section 82. In concert therewith, bulged portion 306 has a transversely enlarged peripheral wall or a taper leading thereto which abuts against frusto-conical segment 78 thereby providing a positive longitudinal stop.

Figure 18:
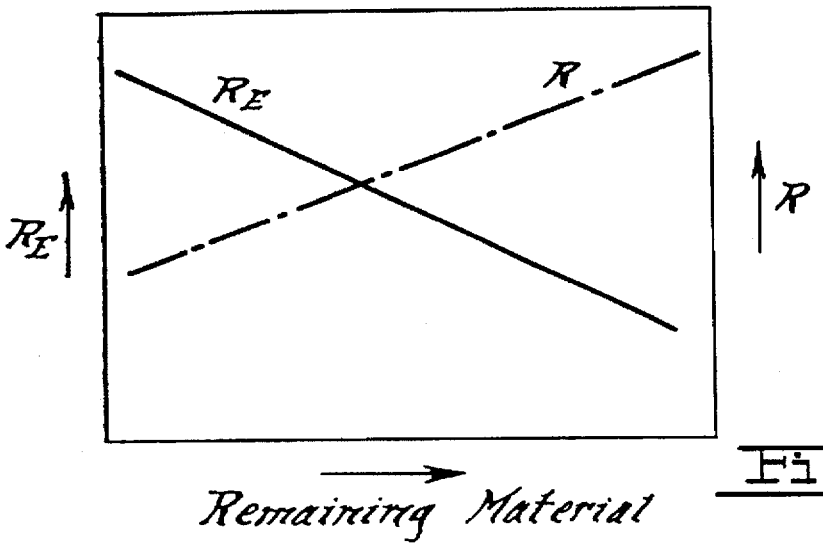
FIG. 18 is a graph displaying the relationship of the electrical resistance and the spring rate in relation to solid portions adjacent to a given pair of apertures within the above embodiments of the female electrical connector of the present invention.
Figure 15:
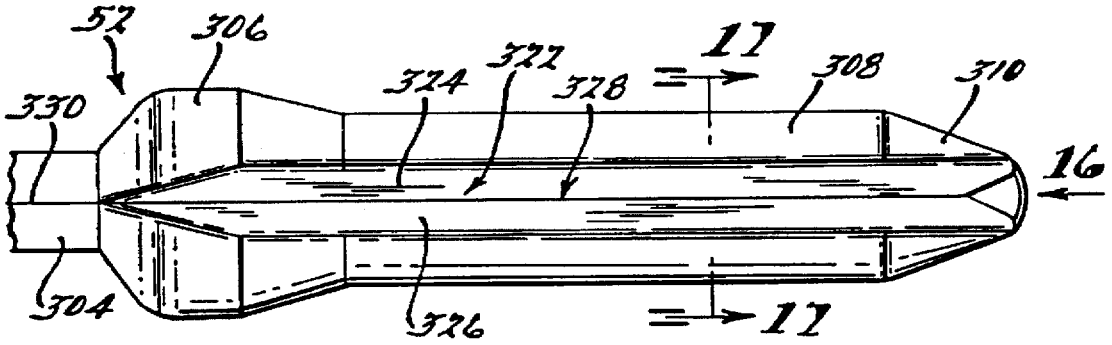
FIG. 15 is an enlarged fragmentary top elevational view of the preferred embodiment of the male electrical connector of the present invention of FIG. 5.
Figure 16:
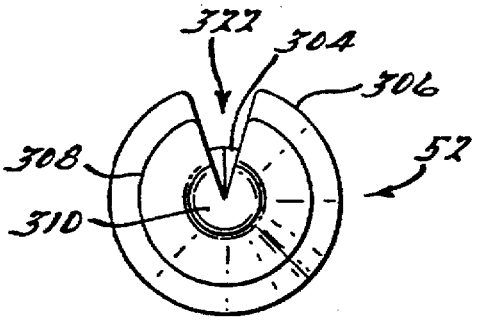
FIG. 16 is an enlarged end elevational view, taken in the direction of arrow 16 from FIG. 15, of the preferred embodiment of the male electrical connector of the present invention.
Figure 17:
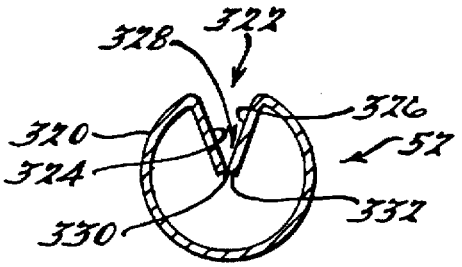
FIG. 17 is a cross sectional view, taken along line 17—17 of FIG. 15, of the preferred embodiment of the male electrical connector of the present invention.

The pair of improved apertures 100 allow receptacle segment 76 of female electrical connector 50 to flex sufficiently to account for any axial misalignment of male electrical connector 52 inserted therein. Accordingly, remaining solid portions 120 (see FIG. 8) cause receptacle segment 76 adjacent to seam 122 to flex easily with remaining solid portion 124 (see FIG. 8). Thus, theoretically, exterior surface 400 of shaft segment 308 is in full electrical contact with the remaining interior surface 402 of collar section 82 resulting in an optimum contact area. This provides for lower and often more desirable insertion efforts of male electrical connector 52 within female electrical connector 50 and provides for lower electrical resistance, lower resistance generated heat and improved stress relaxation characteristics within female electrical connector 50. As can be seen in FIGS. 9 and 10, the improved electrical current paths between male electrical connector 52 and female electrical connector 50 are denoted by the arrows extending therebetween. Electrical path dispersion is improved and the electrical continuity is more secured even for an extended period of time. Also, referring to FIGS. 9 and 17, collar section 82 of female electrical connector 50 is able to radially compress male electrical connector 42 so that walls 324 and 326 approach toward one another within channel 322 so as to account for diametral mismatches therebetween. Furthermore, inwardly turned edges 332 are prevented from scarring and removing the protective plating from interior surface 402 of collar section 82. In FIG. 18, a graph represents the material spring rate (R) and the electrical resistance (RE) of the remaining solid portions circumferentially bordering the apertures of a given length within the previously disclosed embodiments of the present invention female electrical connector.

While the preferred embodiments of these female and male electrical connectors have been disclosed, it will be appreciated that various modifications may be made without departing from the present invention. For example, the apertures within female electrical connector may take on many other polygonal or closed-curved shapes as long as solid portions circumferentially remain between each aperture. Furthermore, the receptacle segment within each female electrical connector may have a variety of polygonal or rounded cross sectional shapes thereto. Moreover, both male and female electrical connectors may be attached to their respective conductive wires through soldering or separate crimped-on bushings. Various materials have been disclosed in an exemplary fashion, however, a variety of other materials may of course be employed. It is intended by the following claims to cover these and any other departures from the disclosed embodiments which fall within the true spirit of this invention.

The invention claimed is:

1. A male electrical connector electrically coupled with an electrically conductive wire, said male electrical connector comprising:

a wire attachment segment securely affixed to a predetermined portion of said conductive wire;

a pedestal segment having a substantially cylindrical shape electrically coupled to and extending from between said wire attachment segment;

a constricted segment being disposed against said pedestal segment;

a bulged segment electrically coupled to and extending coaxially from said constricted segment, said bulged segment having a larger peripheral wall as measured transversely to a longitudinal axis than said constricted segment;

a shaft segment electrically coupled to and projecting coaxially from said bulged segment, said shaft segment having a cylindrical wall of smaller diameter than said transverse measurement of said peripheral wall of said bulged segment, said shaft segment further having a longitudinal channel with a trough substantially parallel to said longitudinal axis, said trough of said longitudinal channel being coincidental with a seam longitudinally extending along said shaft segment and said longitudinal channel having a substantially V-shaped cross sectional configuration such that said shaft is radially compressible, depending walls defining said trough projecting internal from and being turned from said cylindrical wall of said shaft segment; and a head segment having a tapered configuration pointing away from said shaft segment.

2. An electrical connection comprising:

a female electrical connector comprising:

a wire attachment segment securely affixed to a predetermined portion of said wire;

a receptacle segment electrically coupled with said wire attachment segment, said receptacle segment being substantially hollow; and a pair of apertures each being defined by an inner edge longitudinally juxtapositioned within said receptacle segment, said pair of apertures each being circumferentially separated from one another on all edges by solid portions of said receptacle segment;

a male electrical connector comprising:

a wire attachment segment securely affixed to a predetermined portion of said wire;

a bulged segment electrically coupled to said wire attachment segment, said bulged segment having a peripheral wall; and a shaft segment electrically coupled to and projecting coaxially from said bulged segment, said shaft segment having a cylindrical wall of smaller diameter than a transverse measurement of said peripheral wall of said bulged segment, said shaft segment further having a longitudinal channel with a radially extending wall inwardly turned from said cylindrical wall, said longitudinal channel having an internal bottom trough substantially parallel with said longitudinal axis; and a portion of said shaft segment of said male electrical connector being insertable within said receptacle segment and past said pair of apertures of said female electrical connector such that said male and female electrical connectors are electrically connectable to each other, said pair of apertures within said female electrical connector and said longitudinal channel of said male electrical connector allowing said male electrical connector to be easily insertable within said receptacle segment of said female electrical connector.

3. The electrical connection of claim 2 wherein:

said inner edge surrounding each of said pair of apertures is further defined by at least four straight edge sections which form a substantially trapezoidal shape.

4. The electrical connection of claim 3 wherein:

an adjacent pair of said edge sections are juxtaposed perpendicularly so as to create a right angle.

5. The electrical connection of claim 4 wherein:

said inner edge surrounding each of said pair of apertures is rectangular in shape and elongated in a longitudinal direction.

6. The electrical connection of claim 5 wherein:

at least one of said corners of said rectangularly-shaped inner edge has a rounded configuration.

7. The electrical connection of claim 2 wherein:

said inner edge surrounding each of said pair of apertures within said receptacle segment are further defined by at least three straight edge sections.

8. The electrical connection of claim 7 wherein:

said inner edge surrounding each of said pair of apertures is octagonally shaped.

9. The electrical connection of claim 8 wherein:

said octagonally shaped inner edge is elongated in a longitudinal direction.

10. The electrical connection of claim 7 wherein:

each of said inner edges is shaped so as to create an L-shaped aperture.

11. The electrical connection of claim 2 further comprising:

a neck segment having said wire attachment segment electrically coupled thereto and having said receptacle segment electrically coupled thereto; and a lead-in segment electrically coupled to and protruding coaxially from said receptacle segment and angularly opening outward therefrom.

12. The electrical connection of claim 11 further comprising:

a base segment having a substantially cylindrical shape electrically coupled to and linearly juxtapositioned between said wire attachment segment and said neck segment, said base segment being coaxial with said neck segment.

13. The electrical connection of claim 11 wherein said receptacle segment includes:

a barrel section and a collar section, said barrel section having a substantially cylindrical shape being electrically coupled with and coaxially extending from said neck segment, said collar section being electrically coupled to and coaxially projecting from said barrel section and having a smaller diameter than said barrel section, an inside surface of said collar section being matable with a male electrical connector.

14. The electrical connection of claim 2 wherein:

said female electrical connector is stamped as a single part from a conductive metallic material.

15. The electrical connection of claim 2 wherein:

said pair of apertures are symmetrical with one another.

16. The electrical connection of claim 2 wherein:

said longitudinal channel is coincidental with a seam longitudinally extending along said shaft segment.

17. The electrical connection of claim 16 wherein:

said longitudinal channel has a substantially V-shaped cross sectional configuration.

18. The electrical connection of claim 2 further comprising:

a constricted segment being electrically coupled to said wire attachment segment and said bulged segment; and a head segment having a tapered configuration pointing away from said shaft segment.

19. The electrical connection of claim 18 further comprising:

a pedestal segment having a substantially cylindrical shape electrically coupled to and linearly juxtapositioned between said attachment segment and said constricted segment, said pedestal segment being coaxial with said constricted segment.

20. The electrical connection of claim 2 wherein:

said shaft is radially compressible.

21. The electrical connection of claim 2 wherein:

said male electrical connector is stamped as a single part from an electrically conductive metallic material.

* * * * *